US005816879A

United States Patent [19]

Kyame

[11] Patent Number: 5,816,879

[45] Date of Patent: Oct. 6, 1998

[54] FLINGABLE FLYING DISC TOY WITH A CENTRAL OPENING WITH INWARDLY DIRECTED VANES

[76] Inventor: Joseph J. Kyame, 32 Warbler St., New Orleans, La. 70124

[21] Appl. No.: 482,912

[22] Filed: Jun. 8, 1995

[51] Int. Cl.[6] ..... A63H 27/00; A63B 65/10

[52] U.S. Cl. ..... 446/48; 473/589

[58] Field of Search ..... 446/36, 46, 47, 446/48; 273/424, 425, 426

[56] References Cited

U.S. PATENT DOCUMENTS

| | | | |
|---|---|---|---|
| 100,466 | 3/1870 | Taylor . | |
| D. 217,629 | 5/1970 | Davis . | |
| D. 221,453 | 8/1971 | Swanberg . | |
| D. 221,967 | 9/1971 | Sheard . | |
| 770,327 | 9/1904 | Smith . | |
| 2,304,215 | 12/1942 | Streubel | 446/48 |
| 2,835,073 | 5/1958 | Dame . | |
| 2,993,694 | 7/1961 | Foley | 273/425 X |
| 3,019,555 | 2/1962 | Poticha . | |
| 3,765,122 | 10/1973 | English . | |
| 3,852,910 | 12/1974 | Everett . | |
| 4,045,029 | 8/1977 | Katzmark . | |
| 4,104,822 | 8/1978 | Rodgers . | |
| 4,112,612 | 9/1978 | Woods . | |
| 4,185,826 | 1/1980 | Ueng . | |
| 4,203,249 | 5/1980 | Böhm . | |
| 4,204,357 | 5/1980 | Harrington . | |
| 4,216,611 | 8/1980 | Psyras . | |
| 4,246,720 | 1/1981 | Stone . | |
| 4,302,901 | 12/1981 | Psyras . | |
| 4,334,385 | 6/1982 | Melin et al. . | |
| 4,421,320 | 12/1983 | Robson . | |
| 4,560,358 | 12/1985 | Adler . | |
| 4,591,164 | 5/1986 | Blight . | |
| 4,854,907 | 8/1989 | Holmes . | |
| 4,906,007 | 3/1990 | Mitchell et al. . | |
| 4,934,713 | 6/1990 | Hunter . | |
| 4,946,173 | 8/1990 | Schlegel et al. . | |
| 5,066,258 | 11/1991 | Tomberlin . | |
| 5,080,624 | 1/1992 | Brinker . | |

FOREIGN PATENT DOCUMENTS

| | | | |
|---|---|---|---|
| 513863 | 6/1955 | Canada . | |
| 1026393 | 2/1978 | Canada | 273/425 |
| 379907 | 7/1907 | France | 273/425 |
| 836448 | 4/1952 | Germany | 273/425 |

*Primary Examiner*—Robert A. Hafer
*Assistant Examiner*—D. Neal Muir
*Attorney, Agent, or Firm*—C. Emmett Pugh; Pugh/Associates

[57] ABSTRACT

A flingable, disk-like, flying toy (10) having a series of preferably bendable, radially inwardly directed vanes (13) extending out of the plane (11) of the disk, which can cause the toy to spiral and/or return to the user like a boomerang. The throwing disc has an open center (12), in which there is included about and in the inner, circular periphery the series of generally triangular, radially and inwardly arrayed, upwardly protruding fins or generally triangularly-shaped vanes or upwardly bent cut-outs (13) extending into the circular opening, which cause the disc to alter the normal path of a classic "Frisbee" type design, for example, causing the disc to spiral or to tend to return to the thrower. The vanes can be bent further inwardly or outwardly, i.e., up and down, about fold lines (14) to significantly vary the aerodynamic characteristics of the flying disc toy.

9 Claims, 2 Drawing Sheets

FLINGABLE FLYING DISC TOY WITH A CENTRAL OPENING WITH INWARDLY DIRECTED VANES

TECHNICAL FIELD

The present invention relates to toys, and more particularly to flying toys of the type that are flung or thrown into and through the air, in the general fashion of a "Frisbee," and have the capacity of some sustained flight with significant aerodynamic action.

BACKGROUND ART

There are many forms and types of flying toys, including those that are thrown by hand, in the fashion of a "Frisbee."

Some prior patents, which are considered pertinent to the invention, are outlined below.

| U.S. Pat. No. | Inventor(s) | Issue Date |
|---|---|---|
| 100,466 | Taylor | 03/01/1870 |
| D.221,453 | Swanberg | 08/17/71 |
| 2,825,073 | Dame | 05/20/58 |
| 3,765,122 | English | 10/16/73 |
| 3,852,910 | Everett | 12/10/74 |
| 4,045,029 | Katzmark | 08/30/77 |
| 4,104,822 | Rodgers | 08/08/78 |
| 4,185,826 | Ueng | 01/29/80 |
| 4,203,249 | Böhm | 05/20/80 |
| 4,204,357 | Harrington | 05/27/80 |
| 4,216,611 | Psyras | 08/12/80 |
| 4,246,720 | Stone | 01/27/81 |
| 4,302,901 | Psyras | 12/01/81 |
| 4,334,385 | Melin et al | 06/15/82 |
| 4,421,320 | Robson | 12/20/83 |
| 4,591,164 | Blight | 05/27/86 |
| 4,560,358 | Adler | 12/24/85 |
| 4,854,907 | Holmes | 08/08/89 |
| 4,906,007 | Mitchell et al | 03/06/90 |
| 4,934,713 | Hunter | 06/19/90 |
| 4,946,173 | Schlegel et al | 08/07/90 |
| 5,066,258 | Tomberlin | 11/19/91 |
| 5,080,624 | Brinker | 01/14/92 |

The references of the above list have been divided into three groupings for discussion purposes—(1) those having to do with throwing or flying discs, such as the "Frisbee;" (2) boomerangs (viz., U.S. Pat. Nos. 4,421,320, 4,591,164 & 4,934,713); and (3) other, different types of flying or spinning toys (viz., Des. Pat. No. 100,466 of 1870; Des. Pat. Nos. 221,453, 2,835,073 & 5,066,258).

As can be seen from a review of the "flying disc" references, there have been a number of different, cross-sectional configurations suggested for the classic "pie pan" type with the smooth, circular configuration of the original "Frisbee" or throwing disc design.

For example, the patent to English (U.S. Pat. No. 3,765,122) discloses a "flying toy" having an open, central area having the configuration of an annular ring. Note also the patents to Rogers (U.S. Pat. No. 4,104,822), Adler (U.S. Pat. No. 4,560,358) and Holmes (U.S. Pat. No. 4,854,907).

Variations of this "ring" theme are shown in the patents to Böhm (U.S. Pat. No. 4,203,249) and Jörg-Frieder Schlegel et al (U.S. Pat. No. 4,946,173). In these patents the centers of the discs are open and the outer peripheries have "wings" or undulations. In the latter, the undulations extend both along the inner as well as the outer peripheries of the disc.

Unlike the "ring" discs above in which the radial extent of the opening is substantially greater than the radial extent of the solid ring, the Mitchell et al patent (U.S. Pat. No. 4,906,007) has a central opening or aperture apparently comparable in size to that of the present invention. In the embodiment of FIG. 7 aperture spoilers 36 are provided in the form of "a plurality of peaked ridges constructed in a zigzag pattern around the inner surface of the circumscribing lip 20." Apparently the peaked ridges do not extend up above the surface of the disc but rather lie in the plane of the disc, and apparently they are provided to facilitate low-drag air flow through the central aperture.

The rest of the throwing disc toys of the above list have solid centers with different types of configurations.

The Everett patent (U.S. Pat. No. 3,852,910) includes a series of radially disposed airfoils 16 on its upper, curved surface of the throwing disc.

The Katzmark patent (U.S. Pat. No. 4,045,029) discloses a disc with orifices which includes a series of dihedral vanes 34 (note FIG. 7 embodiment) toward the center of the disc.

The Ueng patent (U.S. Pat. No. 4,185,826) includes a series of radially disposed, rotatable leaves.

The Psyras patent (U.S. Pat. No. 4,216,611) uses a series of radially extending air spoilers to disrupt the flow of air over the convex surface of the disc; while the Psyras patent (U.S. Pat. No. 4,302,901) uses a series of spiral-shaped air spoilers.

The Stone patent (U.S. Pat. No. 4,246,720) provides an attachment for a flying disc in which the attachment has a plurality of cantilevered, flexible, radial vanes extending over the upper surface of the disc, producing an undulating fight path.

The Brinker patent (U.S. Pat. No. 5,080,624) includes at least two spinners rotatably mounted on a centered axle, each of which has a number of radially arrayed fins, which cause the spinners to rotate in counter directions, causing the toy to lift when thrown with a twisted motion.

The patents to Harrington (U.S. Pat. No. 4,204,357) and to Melin et al (U.S. Pat. No. 4,334,385) are noted just for general interest and are directed to weight distribution aspects of the flying disc design.

With respect to the "boomerang" patents, it is noted that the patent to Hunter (U.S. Pat. No. 4,934,713) discloses a disc like device having an open center with three, radially disposed, "V" shaped airfoils spaced about its periphery.

With respect to the "other types" of devices, each of these devices includes some type of a rotatable, circular shaped toy, which has some form of radially arrayed, upwardly or downwardly extending members.

The Taylor Des. Pat. No. 100,466 (1870) patent is directed to a "paper wind-wheel" having a series of somewhat triangularly shaped, cut parts "D" forming radial arms "B". It is believed that these arms provide "wind-mill" type extensions which catch the wind and cause the toy to rotate about a central pin axis.

The Swanberg patent (Des. Pat. No. 221,453) is directed to a "flying top toy" which includes a series of what appear to be air scoop wings which cause the top to fly when it is rotated at a relatively high speed through the top mechanism. It is noted, for example, that, although the top includes a center opening, the wing openings do not extend to and interconnect with the central opening, as is true of the present invention. The Tomberlin patent (U.S. Pat. No. 5,066,258) has a somewhat similar design but in the form apparently of a tethered, "Yo-Yo" type action.

The Dame patent (U.S. Pat. No. 2,835,073) is directed to a "flying saucer" in which a set of ninety-degree separated "curved blade elements" serving as air intakes and exhausts are included in opposite directions on the top and bottom, curved surfaces of the hollow toy and apparently provide some lift to the toy.

Although, like most inventions, various details of the present invention are shown in individual ones of the prior patents, none of the embodiments of the patents is identical to the invention, and there is substantial, significant and "unobvious" novelty to the invention. In particular, the aerodynamic action which occurs in the invention is significantly different in kind from those of the prior patents, including, for example, the patents to Katzmark ('029), Psyras ('611), Stone ('720) and Mitchell ('007).

General Discussion of Invention

Thus, the present invention is directed to a "Frisbee" type throwing disc or base, having the capacity of some sustained flight with significant aerodynamic action, in which the center is open and there is included in the inner, circular periphery a series of generally triangular, radially and inwardly arrayed, upwardly protruding fins or vanes or upwardly bent cut-outs extending into the circular opening, which cause the disc to alter the normal path of a classic "Frisbee" type design, for example, causing the disc to spiral or to tend to return to the thrower.

When the toy of the invention is thrown in the horizontal plane, the resulting motion (path or curve) depends on whether the vanes are up or down. Similarly, when the toy is thrown in a vertical plane, or other planes, the resulting motion (path or curve) depends on whether the vanes are up or down. Depending on how it is thrown, the toy can be made to go along a "spiral" path and at times has the tendency to return to the thrower or player, somewhat like a "boomerang."

The aerodynamics and "paths" of the invention are substantially different than that of the "Frisbee" or similar discs or rings.

It is thus a specific object of the present invention to provide a flying toy which has enhanced and preferably variable aerodynamic action in its flight paths.

It is another object of the present invention to provide a flingable, disk-like flying toy having a series of preferably bendable, radially inwardly directed vanes extending out of the plane of the disk and extending into the central opening, which can cause the toy to spiral and/or return to the user like a boomerang.

It is a further object of the invention to provide such a flying toy in which the vanes are separately variable in their angles with respect to the base or ring portion of the disk.

BRIEF DESCRIPTION OF DRAWINGS

For a further understanding of the nature and objects of the present invention, reference should be made to the following detailed description, taken in conjunction with the accompanying drawings, wherein:

FIG. 1 is a perspective view of an exemplary embodiment of the flying toy of the present invention; while

BEST MODE FOR CARRYING OUT THE INVENTION

Figure 2:
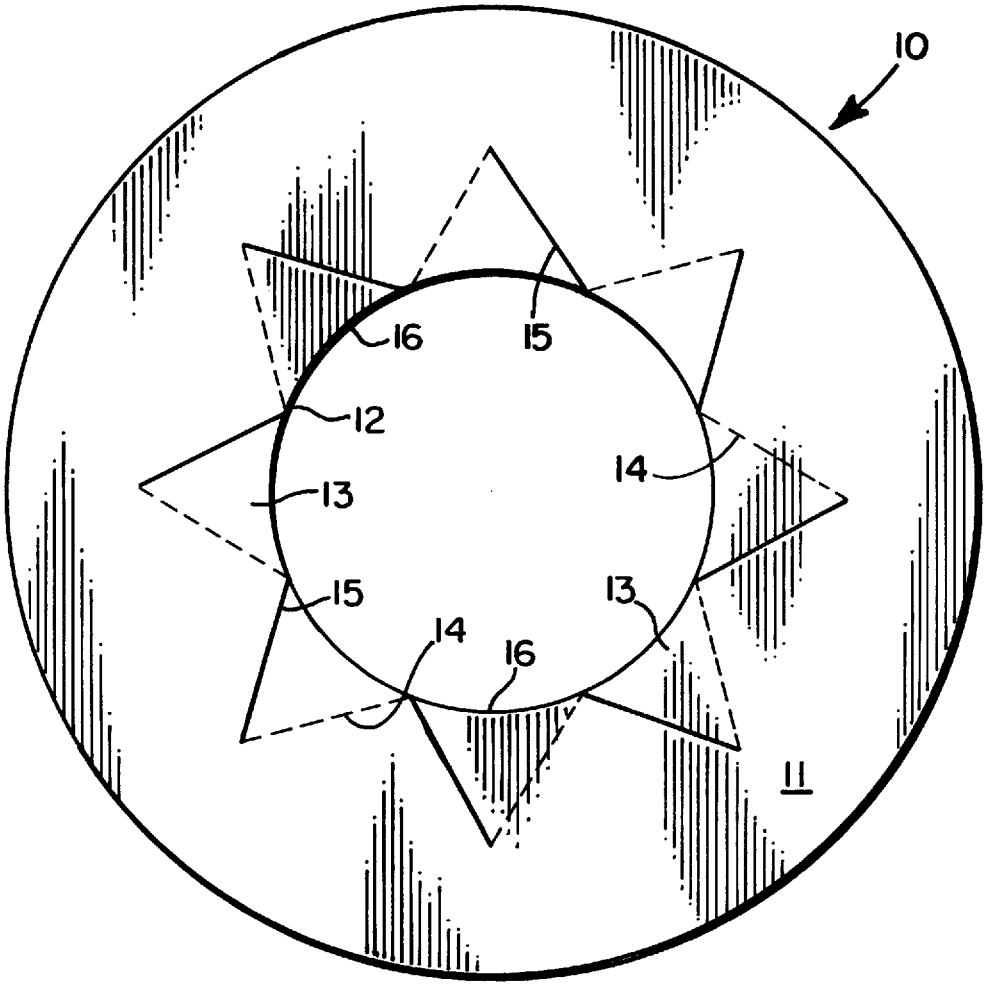
FIG. 2 is a plan view of the flying toy illustrated in FIG. 1.
Figure 1:
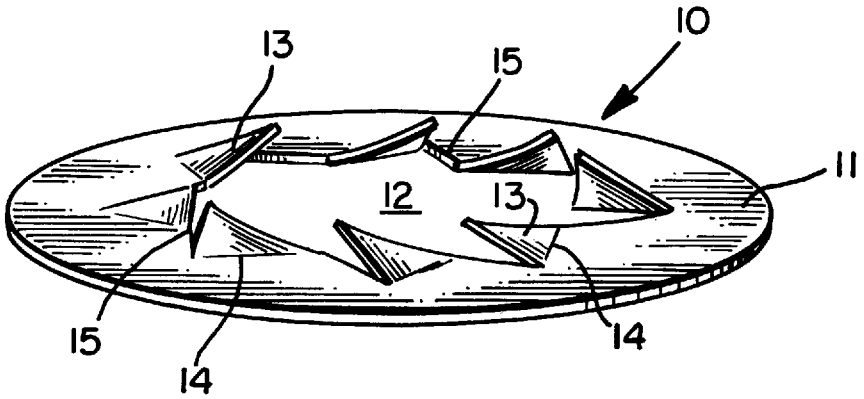
Figure 3:
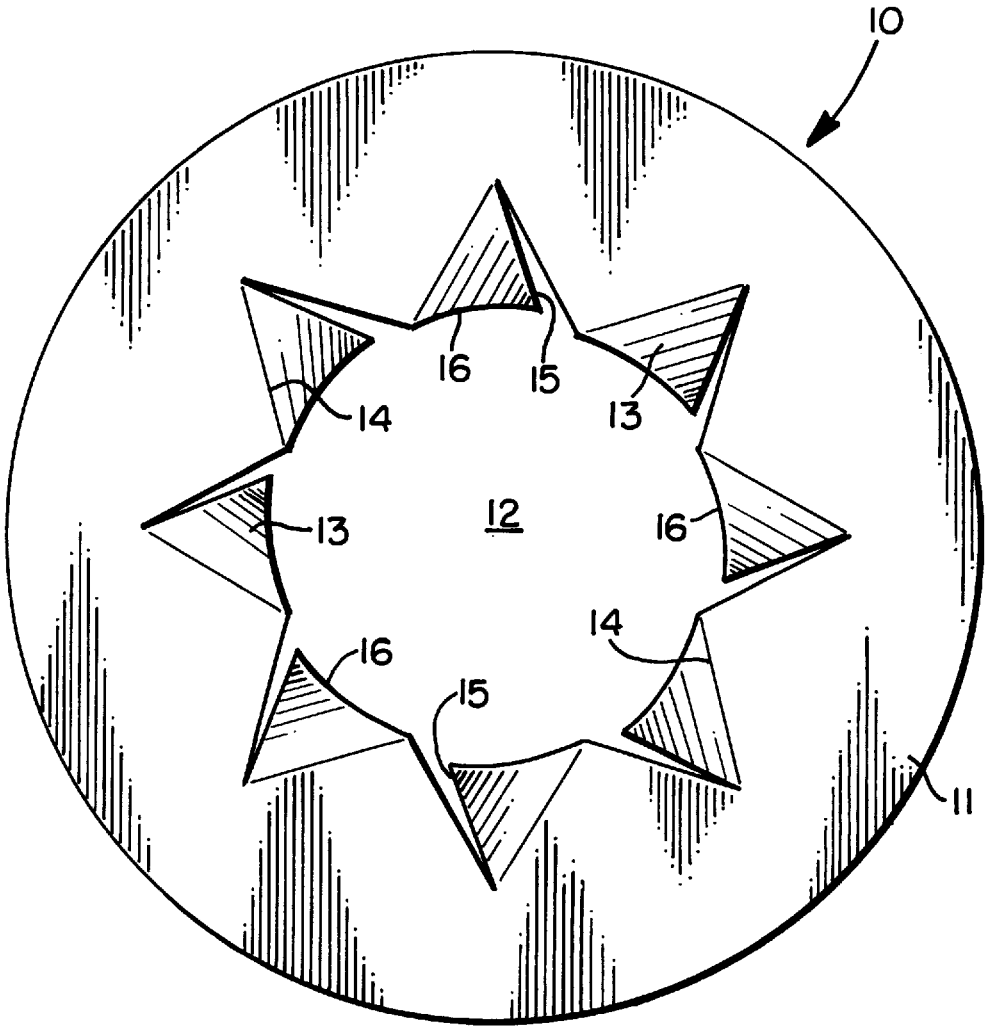
FIG. 3 is an underside view of the flying toy illustrated in FIG. 1.
Figure 4:
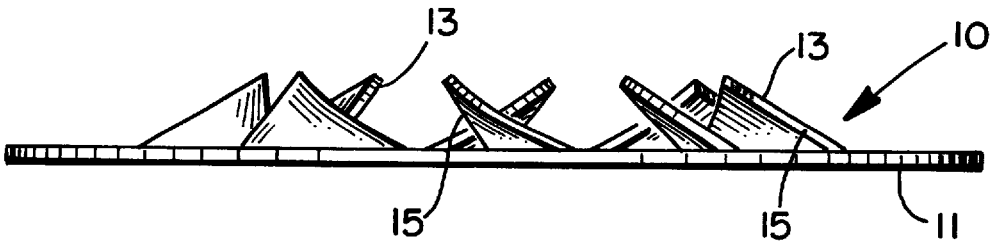
FIG. 4 is a side view of the flying toy illustrated in FIG. 1.

As can be seen in FIGS. 1–4, the preferred, exemplary embodiment 10 of the flying toy (e.g., "FLING-A-RING"™ toy) of the present invention includes a flat, circular base 11 with a central, circular opening 12, the two together forming a ring and having a series of triangularly-shaped, upwardly extending sections or tabs or "vanes" 13 projecting inwardly and up above the plane of the base, about and into the periphery of the circular, central opening. The section tabs or vanes 13 can be bent up at an angle of, for example, about forty-five (45°) degrees from the base 11.

Each section tab or vane 13 preferably is separately and independently bendable about its respective "fold" line 14, which is easily adjusted up and/or down to affect the flight characteristics of the flying toy 10. Alternatively, if so desired, the vanes could be made fixed and unadjustable, each making an angle of, for example, forty-five (45°) with the base 11.

The triangular shape of each vane 13 is formed from its respective "fold" line 14, its respective"cut" out line 15, which forms a leading edge, and its respective portion 16 of the periphery of the central opening 12. The three sides 14, 15 and 16 or, more technically the chord which subtends the latter, are preferably equal, forming effectively an isosceles triangle, with each adjacent set of sides forming sixty (60°) angles. Additionally, all of the vanes 13 preferably are substantially identical in their size and configuration.

The vanes 13 also preferably occupy the complete periphery of the central opening 12, with each being immediately adjacent to the other, with the extended tip 17 of the leading edge 15 being coincident with the end of the "fold" line 14 of the next, adjacent vane. Thus, preferably the total of all of the vanes' respective peripheries is equal to the periphery of the central opening 12, with the leading tip of one being coincident with the following tip of the next vane. Hence, when all of the vanes 13 are folded flat, the toy 10 has the appearance of a simple ring with, for example, eight (8) "cut" lines aligned at diagonal lines to the periphery of the central opening 12.

There preferably are at least three (3) vanes, with the eight (8) vanes 13 illustrated being most preferred. Additionally, the outer periphery 18 of the base 11 preferably is smooth and uncluttered.

The presence of the vanes 13 causes the flying toy 10 to spiral and twist as it flies, after it has been thrown by hand and typically spun through the air. The toy 10 has the capacity of some sustained flight, that is, it can move up, down and at angles due to its interaction with the air flow around and through it, with significant aerodynamic action.

When the flying toy 10 is thrown in the horizontal plane, the resulting motion (path or curve) depends on whether the vanes are up or down. Similarly, when the toy is thrown in a vertical plane, or other planes, the resulting motion (path or curve) depends on whether the tab sections or vanes 13 are up or down or, more accurately, left or right. Also, depending on how it is thrown, the flying toy 10 can be made to go along a "spiral" path and at times has the tendency to return, somewhat like a "boomerang."

Exemplary dimensions, which are subject to much variation, are outlined below:

| Toy Part | Exemplary Dimension |
|---|---|
| Outer Diameter of Toy 10 | 10.5" |
| Diameter of Opening 12 | 4.5" |
| Up-Angle of Tabs 13 | 45° |
| Length of Fold Line 14 | 2" |
| Length of Cut-Line 15 | 2" |

-continued

| Toy Part | Exemplary Dimension |
|---|---|
| Length of Chord Subtending Periphery Section 16 | 2" |
| Angle between Fold Line 14 & Cut-Line 15 | 60° |

The flying toy 10 can be made of plastic, light metal, cardboard, or other suitable material, which is light weight and has sufficient structural strength to hold its basic shape when it is flung through the air. Two or more toys 10 can be provided in a set, with the "vanes" bent "up" on one and "down" on the other for right and/or left hand flinging.

The toy 10 can have a an over-all diameter of a minimum of about four (4") inches to a maximum of about four (4') feet, with the other dimensions being proportional, although toys having diameters up toward the maximum of about four (4') feet can be relatively difficult to fling in a controlled manner. A more typical diameter is that of the exemplary embodiment, i.e., about (10.5") inches or in the range of about ten (10") to about a foot (1').

Although preferably flat, the base 11 can be curved, having, for example, a smoothly flowing, curved, "horizontal" cross-section, similar to that of a wing, with its apex on the same or on the opposite side of the vanes 13.

It is noted that the words "upwardly" & "up" and "down" in this specification are used in their relative sense, i.e., in relationship to the plane of the base 11, and not literally in the vertical sense with reference to the ground.

While the present invention has been shown and described in what is at this time currently believed to be most the practical and preferred embodiment, it is recognized that departures may be made therefrom within the scope of the invention, which therefore is not to be limited to the details disclosed herein, but it is to be accorded the full scope of the claims as to embrace any and all equivalent devices and approaches.

Thus, the embodiment described herein in detail for exemplary purposes is subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

I claim:

1. A flying toy disc for flinging through the air by hand, comprising:

a circular base with a central opening forming an inner periphery having an over-all distance across said base being within the range of at least about four inches to a maximum of about four feet;

a series of generally triangularly-shaped, upwardly extending vanes projecting radially inwardly, as well as upwardly above the plane of the base, about and into the periphery of the circular, central opening, said base with said vanes being capable of some sustained flight with significant aerodynamic action, the relative positions of said vanes with respect to said base causing the disc to spiral or to tend to return the toy disc to the thrower, after it has been thrown through the air by hand;

said vanes are separately and independently adjustable about "fold" lines, each of which forms a side of the triangular shape of its respective vane, with the other two sides of the triangular shape being formed by a leading edge and the associated periphery of said opening, the radial end of said "fold" line intersecting with the vane's associated periphery of said opening; said opening is circular; and said vanes are adjacent to one another, with each vane's inwardly most tip being coincident with the intersection of the adjacent vane's "fold" line and said associated periphery of the adjacent vane.

2. The flying toy of claim 1, wherein:

said vane's inwardly most extended tip is coincident with the intersection of the "fold" line of the adjacent vane with the associated periphery of the adjacent vane, when said vanes are folded flat into the plane of the base, the complete periphery of said central opening being occupied by said vanes.

3. The flying toy of claim 1, wherein:

said base and said central opening forming a ring.

4. The flying toy of claim 1, wherein:

the generally triangular shape of said vanes is substantially that of an isosceles triangle, with all of said vanes being substantially identical in size and configuration.

5. The flying toy of claim 1, wherein:

said base is flat.

6. The flying toy of claim 1, wherein:

each of said vanes is flat.

7. The flying toy of claim 1, wherein:

said vanes each extend up at an angle of about forty-five (45°) degrees with respect to said base.

8. A flying toy disc for flinging through the air by the player's hand, comprising:

a flat, circular base with a central, circular opening forming an inner periphery and a ring, said base having a diameter within the range of about ten inches to about a foot; and a series of generally triangularly-shaped, upwardly extending vanes projecting radially inwardly, as well as upwardly above the plane of the base, about the periphery of the circular, central opening, said vanes being separately and independently adjustable about "fold" lines, each "fold" line forming a side of the generally triangular shape of its respective vane, with the other two sides of the triangular shape being formed by a leading edge and the associated periphery of said opening, the radial end of said "fold" line intersecting with the vane's associated periphery of said opening, with all of said vanes being substantially identical in size and configuration, said vanes each extending up at an angle of about forty-five (45°) degrees with respect to said base, the relative positions of which with respect to said base causing the toy disc to spiral or to tend to return the toy disc to the thrower.

9. A flying toy disc for flinging through the air by the player's hand, comprising:

a flat, circular base with a central, circular opening forming a ring, said base having a diameter within the range of about ten inches to about a foot;

a series of generally triangularly-shaped, upwardly extending vanes projecting radially inwardly, as well as upwardly above the plane of the base, about the periphery of the circular, central opening, said vanes being separately and independently adjustable about "fold" lines, each of which forms a side of the generally triangular shape of its respective vane, with the other two sides of the triangular shape being formed by a leading edge and the associated periphery of said opening, the radial end of said "fold" line intersecting with the vane's associated periphery of said opening, with all of said vanes being substantially identical in size and configuration, said vanes each extending up at an angle of about forty-five (45°) degrees with respect to said base, the relative positions of which with respect to said base causing the toy disc to spiral or to tend to return the toy disc to the thrower; and said vanes are adjacent to one another, said vane's inwardly most tip is coincident with the intersection of the "fold" line with the periphery of its adjacent vane when said vanes are folded flat into the plane of the base, the complete periphery of said central opening being occupied by said vanes, said triangular shape being substantially that of an isosceles triangle.

* * * * *